US006817126B2

(12) United States Patent
Ramar

(10) Patent No.: US 6,817,126 B2
(45) Date of Patent: Nov. 16, 2004

(54) ASSEMBLY OF PLANT INFORMATION LABEL AND A PLANT STAKE

(76) Inventor: Rudolf Ramar, Paduahof 4, 3734 GG Den Dolder (NL)

( * ) Notice: Subject to any disclaimer, the term of this patent is extended or adjusted under 35 U.S.C. 154(b) by 290 days.

(21) Appl. No.: 09/736,439

(22) Filed: Dec. 15, 2000

(65) Prior Publication Data

US 2002/0020094 A1 Feb. 21, 2002

(30) Foreign Application Priority Data

Dec. 24, 1999 (NL) ..... 1013950

(51) Int. Cl.[7] ..... G09F 23/00
(52) U.S. Cl. ..... 40/645; 40/607
(58) Field of Search ..... 40/645, 607, 611, 40/124.4, 377, 492

(56) References Cited

U.S. PATENT DOCUMENTS 429,650 A * 6/1890 Scott ..... 52/103
1,153,371 A * 9/1915 Carter ..... 248/244
1,247,622 A * 11/1917 Berrigan ..... 292/288
1,863,608 A 6/1932 Stewart
2,639,524 A * 5/1953 Irving ..... 40/645
4,250,647 A * 2/1981 Woodard ..... 40/617
4,738,060 A * 4/1988 Marthaler et al. ..... 52/103
5,333,391 A * 8/1994 Eldridge et al. ..... 33/760
5,369,902 A * 12/1994 Minster ..... 40/645
5,537,768 A 7/1996 Tesselaar et al.

FOREIGN PATENT DOCUMENTS

AU 9918594 A * 8/2002
CH 651 411 A5 9/1985

* cited by examiner

*Primary Examiner*—Cassandra Davis
(74) *Attorney, Agent, or Firm*—Westman, Champlin & Kelly, P.A.; Steven M. Koehler

(57) ABSTRACT

Assembly of a plant information label provided with an uncircular hole having a largest diameter d, and a plant stake for holding the plant information label, in which the plant stake is provided with abutment surfaces situated on either side, in which at least one abutment surface is formed in a notch, which notch also offers room for rotation for the plant information label.

30 Claims, 2 Drawing Sheets

ASSEMBLY OF PLANT INFORMATION LABEL AND A PLANT STAKE

SUBJECT OF THE INVENTION

The invention relates to an assembly of a plant information label and a plant stake for holding the plant information label.

BACKGROUND OF THE INVENTION

Such an assembly of a plant stake and information label is inserted into the ground at the edge of the pot of a plant in order to provide the consumer with information about the plant. In actual practice many embodiments of such assemblies of information label and plant stake are known. For instance, a plant stake is known having a substantial rectangular cross-section, in which a little button is arranged on the widest side. The accompanying information label has a circular recess which snaps over the little button. A drawback of said assembly is amongst others that it is difficult to read the back of the information label unless the information label is bent or taken from the plant stake or the plant stake including the plant information label is taken out of the ground. When bending the plant stake will moreover move very much, as a result of which the roots of the plant may be damaged. Additionally the label is difficult to place directly. Moreover, in order to be abe to read the information label, the plant stake has to be inserted transverse to the radius of the pot. The drawback of all this is that this again may also quickly lead to damage of the roots because the roots of the plant generally run radially. Moreover the information label sits vertical to the pot, as a result of which it is difficult if not impossible to read the information label from above.

Another embodiment of the known assembly, described above, is an embodiment in which the little button is arranged at the top of the plant stake. A drawback of this is that the label is able to rotate, as a result of which it can no longer be read. Moreover the label often projects far beyond the pot.

A third known embodiment is an assembly in which the plant stick has a circular cross-section, having a transverse plane as a stop when inserting the plant stake into the ground. At its top the plant stake is provided with a curl over which the label can be pulled. A drawback of this structure is that the label is rather difficult to arrange. Moreover the label is able to swing. Additionally, the plant stake is not easy to produce compared to the other plant stakes.

Another known possibility to provide a plant with an information label is by means of an information label that can be inserted into the ground without a plant stake. Such an information label has the drawback of being very broad as a result of which the roots can easily get damaged, and the information being difficult to read from above. The back of such an information label moreover is very hard to read.

Swiss patent specification 651,411 regards an assembly of a pin to be inserted into the ground and card to be snapped onto the pin. The card then remains standing straight up.

U.S. Pat. No. 1,863,608 regards an assembly of a pin and an information label having the text in longitudinal direction of the label. The label is difficult to arrange onto the pin, cannot be removed and moreover, the assembly can rotate into a position in which the label may be difficult to read.

U.S. Pat. No. 5,537,768 regards a plant stake for holding an information label in a clamping manner.

SUMMARY OF THE INVENTION

The object of the invention is to provide a simple assembly of plant stake and plant information label, which does not have the drawbacks mentioned or has them to a lesser extent.

A further object of the invention is to provide a simple assembly of a plant stake which can be manufactured easily and cheaply and an information label which can easily be arranged on it.

An additional object of the invention is to provide an assembly which unites several advantageous properties. The roots, for instance, should be damaged as little as possible when inserting and the plant stake should hold the information label such that it is well-legible and in a rather fixed position and is well-legible to the consumer. Moreover the plant label preferably should not easily get detached from the plant stake.

Additionally the invention has the object of holding the information label such that the back can easily be read, the card remains fixed to a certain extent in a wanted position and the information label can be arranged on the plant stake in a rather simple way.

At least a part of said drawbacks are overcome and a part of the goals are achieved by an assembly of a plant information label provided with an uncircular hole having a largest diameter d, and a plant stake for holding the plant information label, in which the plant stake is provided with abutment surfaces situated on either side, in which at least one abutment surface is formed in a notch, which notch also offers room for rotation for the plant information label.

At least a part of the drawbacks are overcome this way and a part of the goals is achieved. Because of the notch which offers room for rotation to the plant information label it is easy to read the back of the plant information label without having to remove the plant stake out of the pot of a plant or to move the stake in the pot. Additionally such a plant stake is easy to produce and the plant information label can hardly rotate around the plant stake. The room for rotation offers the possibility to revolve the plant information label, about an axis of rotation perpendicular to the longitudinal axis of the plant stick and substantially in the plane of the plant information label, or to tilt, so that the back of the plant information label becomes visible.

Preferably the abutment surface in the notch is situated above the abutment surface on the other side of the plant stake. As a result the information label will hang in an inclined position in the view direction of the consumer. In order to prevent that the information label becomes detached from the plant stake when reading the information at the back of the information label, the plant stake is provided with at least one stop surface on either side for limiting the rotation of the plant information label. In order to rotate the information label almost completely vertically, two stop surfaces are substantially vertically situated above each other. In order to arrange the information label on the plant stake without too much trouble, the ratio between the dimensions of the hole and the length and width of the plant stake is such that the plant information label can be arranged on the stake. Preferably the plant stake comprises a passage portion of which the largest diameter is smaller than the largest diameter of the hole of the plant information label, as a result of which arranging it is facilitated even more, to such an extent even that arranging without deforming the plant information label can become possible. The passage portion of the plant stake then is the portion of the plant stake that the information label has to pass in order to be arranged on the plant stake.

In order to further prevent that the information label can get detached from the plant stake when reading the back of the information label, the downward opening angle between the top of the notch and the longitudinal axis of the plant stake is 90 degrees at a maximum.

For a stable positioning of the information label it is desirable that the upper abutment surface has a vertical component, and in order to prevent that the information label will slip down from the plant stake for instance because of draught from below, the lower abutment surface preferably has a horizontal component. Preferably the plant stake is provided with a shoulder either from or below the upper abutment surface, more preferably the horizontal component of the lower abutment surface forms a shoulder, or it merges into a shoulder.

Additionally, in order to further prevent that the information label can get detached from the top of the plant stake, it is preferred that the shortest distance be-tween the top of the notch and the top of the upper stop surface is longer than the largest diameter of the hole of the plant information label.

In order to prevent rotation of the information label from revolving around the plant stake, the hole in the information is uncircular. Preferably said hole is either substantially slot-shaped or rectangular.

In order to fixate the plant information label well in a wanted position it is desirable that the plant stake has a substantially flat rectangular cross-section. In order to obtain a plant stake that is simple to manufacture, for instance by means of extrusion and subsequent punching out, it is preferred that the plant stake either has no, or substantially no, parts which protrude beyond the contours of the plant stake. Contours here mean the continuation of the otherwise strip-shaped plant stake.

In order to be able to read the information at the back of the information label well, it is preferred that the information on the label runs from top to bottom on the one side and from bottom to top on the other side, that means on the front, the side facing a consumer, preferably from the hole in the information label downwards, and at the back from the lower side of the information label towards the hole.

Specifically, the plant stake offers optimal room for rotation to the information label when the width of the notch, which offers room for rotation, is adjusted to the distance from the top of the information label to the hole therein, particularly when the width of the notch, which offers room for rotation, is larger than the distance from the top of the information label to the hole therein.

In order to prevent an all to quick detachment of the information label it is preferred that the width of the notch which offers room for rotation at a certain depth in the notch, preferably near the outer edge of the plant stake, is smaller than the distance from the top of the information label to the hole therein.

In order to be able to more easily detach the information label from the plant stake, the distance from the bottom of the upper stop surface to the top of the notch, can be smaller than the largest width of the hole of the information label. Additionally, to facilitate lifting, that means rotating or tilting, the information label in order to remove it, or reading the back, the side of the plant stake has a substantially round course from the upper stop surface to below.

In order to prevent the spontaneous detachment of the information label even further, the width of the plant stake above the notch is larger than the largest width of the hole in the information label at at least one location.

A second aspect of the invention relates to the plant stake for holding an information label, in which the plant stake has a maximum thickness D and a maximum width B and is provided with means for holding an information label, in which the plant stake is provided with at least two notches on one side, the upper and lower notch, and on the opposing side with at least one notch, the middle notch, in which the level of the deepest point of the middle notch is between the deepest point of the upper notch and the deepest point of the lower notch, and in which the width measured from the deepest point of the upper notch to the deepest point of the middle notch $I_1$, the width measured from the deepest point of the middle notch and the deepest point of the lower notch, $I_2$, and the generating lines from the deepest point of the middle notch from $I_1$ to $I_2$ are shorter than B and the generating line from the top side of the upper notch to the top and towards the middle notch, $I_3$, is smaller than or equal to B.

Preferably the second aspect of the invention relates to a plant stake having an uncircular cross-section.

In order to easily and unimpededly move an information label possibly to be placed on the plant stake, the plant stake has a smooth course between the upper and the middle notch. For the same reason the part of the plant stake between the upper notch and the middle notch preferably is flattened.

In order to facilitate the arrangement of a possible information label, the top of the plant stake is rounded off in the plane of the width.

In order to hold the plant information label well, it is preferred that the upper notch and the lower notch are substantially wedge-shaped, and preferably also the middle notch is substantially wedge-shaped.

The plant stake according to the second aspect of the invention can preferably be used in cooperation with a plant information label provided with a hole, preferably a rectangular hole having a largest diameter smaller than B. As a result the plant information label does not slip down from the plant stake. For a good presentation it is moreover preferred that the hole is situated near the top.

In order to be able to read the plant information label on both the front and back it is preferred that on one side of the information label information has been printed from the hole downwards, and on the other side of the information label information has been printed running from the bottom of the label towards the hole. That means that the information at the front runs to the edge where the information label is taken hold of to tilt the information label, and at the back from the location where the information label is taken hold of, to the location where the information label is attached to the plant stake.

A plant stake according to the invention can be made from various possible materials such as wood, a synthetic material or metal. For financial reasons such a plant stake is however preferably made from a synthetic material, possibly recycled or mixed with recycled synthetic material and provided with fillers. All this to render the price as attractive as possible.

A plant stake according to the invention preferably is provided with a pointed tip at the bottom as a result of which it can easily be inserted into the ground.

The invention moreover relates to a plant stake for holding a plant information label, which plant stake at the top is provided with a thickening, with a neck below the thickening and with a shoulder below the neck, in which the thickening blocks removal of the plant information label when it is situated in an inclined presentation position or in an upwardly turned position to read the back, or in positions to get from the inclined presentation position into the upwardly turned position, but comprising a passage portion as a result of which the plant information label can be removed from the plant stake, the neck together with the shoulder offering room for tilting the plant information label to read the back without substantially bending the plant information label, and which neck because of an uncircular cross-section corresponding to a hole in the plant information label prevents rotation of the plant information label in the plane of the plant information label and holds the plant information label in an inclined direction to a viewer, and the shoulder preventing the plant information label from sliding down.

By defining a space in order to be able to tilt the plant information label without substantially bending the plant information label, no torque is exerted on the stake when turning it upwards to be able to read the back.

The thickening at the top of the plant information label comprises a passage portion. When the plant information label is turned upwards from the presentation position, that means the position in which the plant information label is fixed to the plant stake in an inclined manner so that the information label is well-legible to the consumer, into a upwardly turned position or turned position, in which the back can be read without substantial bending of the information label, the information label cannot easily get detached from the plant stake. While turning upwards from the presentation position into the turned position a tilting track is followed. Said tilting track is followed freely, guided along the neck.

On the other side a passage portion is indeed defined along which the information label has to be moved in order to detach the information label from the plant stake. Said passage portion preferably renders the information label only detachable when a person acts with the intention to detach the information label. The information label preferably cannot be detached by simple swinging, tilting or holding the plant stake with information label upside-down.

Preferably the plant stake is strip-shaped, additionally the thickening preferably is located within the planes that limit the strip-shaped portion of the plant stake, that means that it has no protruding parts outside/beyond the strip-shaped continuation of the plant stake. As a result the plant stake is easy to produce.

Preferably the cross-section of the neck is adjusted such to the hole in the information label that it can be moved along the tilting track without substantial deformation and can be arranged on the plant stake without substantial deformation.

The invention additionally relates to a plant stake for holding a plant information label, in which the plant stake is provided with a neck, in which the neck has an uncircular cross-section and the plant information label is provided with a corresponding uncircular hole, and in which the neck is formed for guiding the plant information label through the plant stake during tilting the plant information label.

The invention will be further elucidated in the figures which show a preferred embodiment of a plant stake, a plant information label and assembly for it according to the invention. It goes without saying that the invention is not limited to said figures.

SHORT DESCRIPTION OF THE FIGURES

DETAILED DESCRIPTION OF THE PREFERRED EMBODIMENTS

Figure 1:
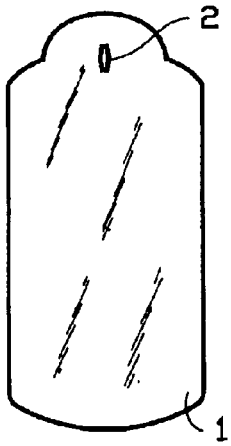
FIG. 1 shows a plant information label.

FIG. 1 shows an example of a plant information label 1 provided with an uncircular recess or hole 2 through which the label 1 can simply be placed on a plant stake. Preferably the hole 2 is rectangular or of such a shape that it can be laid in a rectangle having a length l and a width b, for instance elliptic or slot-shaped. The plant information label is a usual information label, preferably made of a thin synthetic material, which is sufficiently rigid and sufficiently thick to remain level during use. The synthetic material is somewhat flexible, as a result of which the information can be arranged on the plant stake possibly with a little deformation. Preferably, however, the hole is large enough to arrange the information label without difficulty, however, not so large that it can easily get detached from the plant stake. The dimensions of the hole of the plant stake are therefore adjusted to the relevant dimensions of the plant stake, or vice versa.

As shown in the figure the hole 2 preferably is at or near the top of the information label 1, in any case preferably above the centre of gravity of the information label. In general the information at the front of the information label will define either the top side or the bottom side.

Figure 2A:
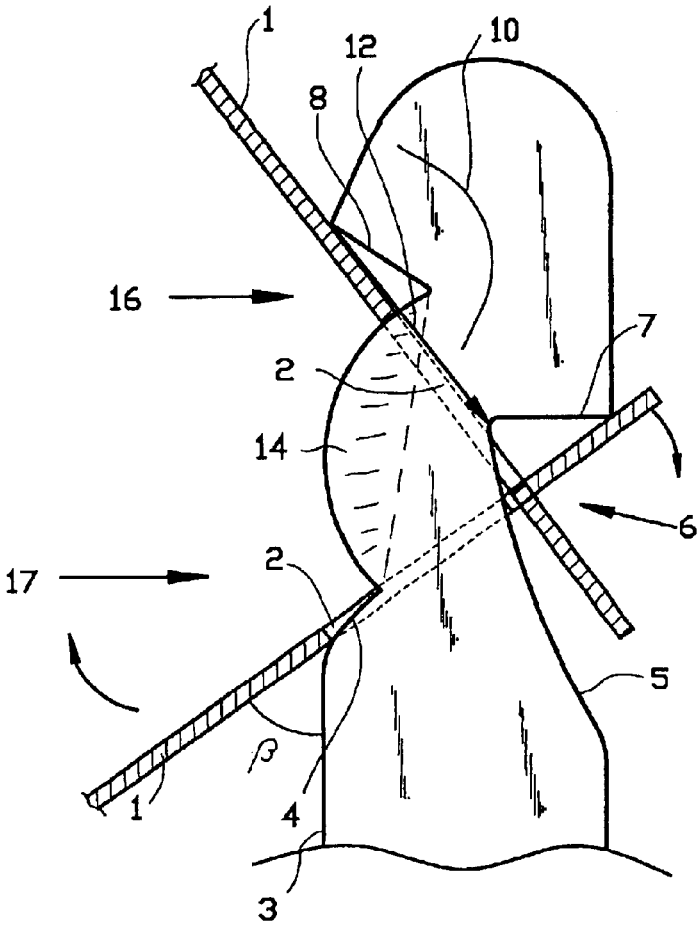
FIG. 2A shows a side view of a preferred embodiment of the plant stake.

In FIG. 2A a preferred embodiment of the plant stake 3 according to the invention can be seen. It can be seen here that the plant stake 3 is provided with a upper notch 16 and lower notch 17, at one side and a middle notch 6 at the opposite side of the plant stake. Furthermore the plant stake has a smooth shape running from the first notch 16 to the second notch 17. Preferably the generating line from the deepest point of the opposite notch 6 of the deepest point of notch 17 to notch 16 is smaller than the diameter of the information label. Additionally the generating line of the stake from the deepest point of the top edge 8 of the upper notch 16 from the farthest removed point of the bottom side 7 of the notch 6 upwards, is always smaller that the largest width of the hole 2, as can be seen in the figure. As a result the information label can be removed from the plant stake along the path indicated by number 10, the passage portion. The generating line of the outside of the stop surface 8, running from the farthest removed side of top side 7 of notch 6 upwards, is at at least one position larger than the largest width of the hole 2. In order to prevent the information label from sliding down too far, the width of the plant stake 3 at some point below notch 17 is larger than the width of hole 2. The plant stake is provided with a shoulder. As a result the information label will simply remain on the stake and will not detach from the stake by wind or by tapping against it. Moreover the information label is easy to attach to the stake by following passage portion 10. The lower notch either is at an angle β to the longitudinal side of the stake as a result of which the information label will neatly remain hanging at said angle β. The information label can also be retained by top side 7 of notch 6, as indicated in FIG. 2A. The opposite notch is at an angle to the side of the stake, for instance equal to β, as a result of which the label when taken up can easily be lifted to that angle.

Figure 2B:
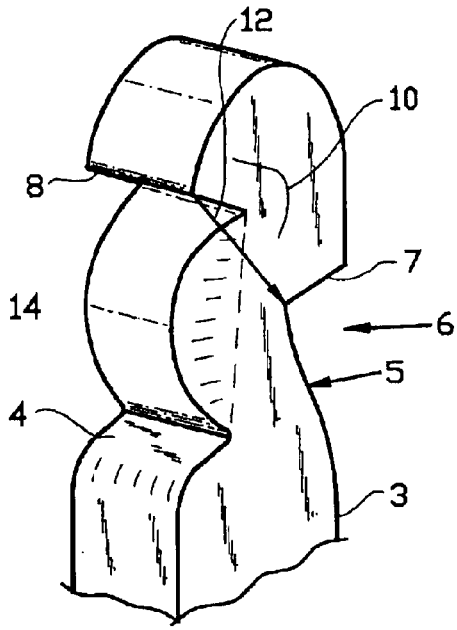
FIG. 2B shows a view in perspective of a preferred embodiment of the plant stake.

FIG. 2B shows a view in perspective of the plant stake according to FIG. 2A. In said drawing it can clearly be seen that the area between notch 16 and 17 tapers a little near 14. As a result the information label can easily be slid over the plant stake. In the figure it can moreover be seen that the plant stake has a flat rectangular cross-section. The plant stake may possibly have a tapering cross-section.

In FIG. 2B the smallest distance between the top side of the upper notch 16 and notch 6 is indicated by number 12. Because said distance is larger than the width of hole 2, the information label is retained and cannot be detached from the stake just like that when reading the back.

Figure 3A:
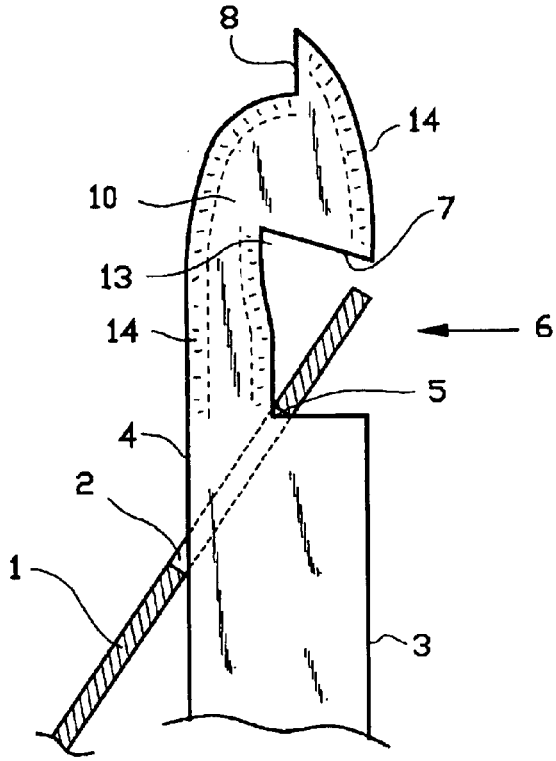
FIG. 3A shows an alternative embodiment of an assembly having the plant information label in a "presentation position".
Figure 3B:
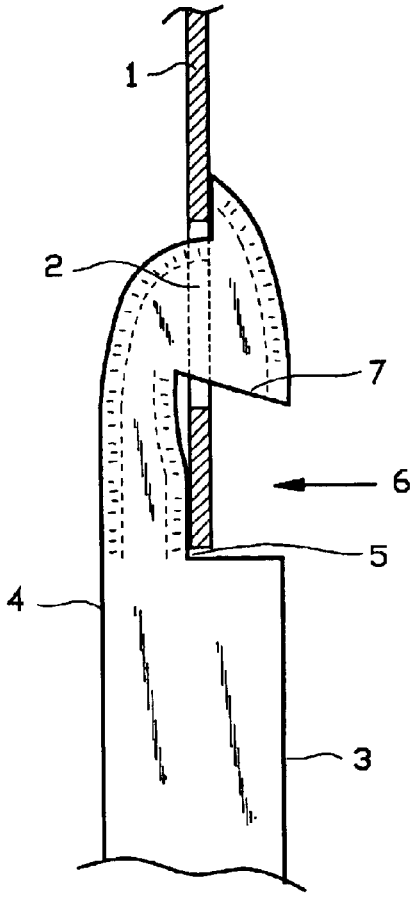
FIG. 3B shows the embodiment of FIG. 3A in which the back of the information label can be read.

FIG. 3A shows another preferred embodiment according the invention. The plant information label 1 abuts abutment surface 4 and abutment surface 5 of the information label 1 provided with hole 2. Abutment surface 4 is positioned lower here, or is situated below abutment surface 5. As a result the information label 1 remains hanging in an inclined position in the "presentation position" and it is well-legible to the consumers. In this embodiment the notch 6 is so wide that the information label can freely rotate from the "presentation position" of FIG. 3A into the position in which the back of the information label can be read (FIG. 3B). To that end the notch is at least as wide as the portion of the information label at the side of the notch. In order to facilitate the tilting upwards, or rotating, of the information label, for instance to be able to read the information at the back, a small recess 13 has been made. In the preferred embodiment the downwardly oriented angle α of the top side of the notch to the longitudinal axis of the plant stake is furthermore smaller or equal to 90 degrees. In this way the information label is prevented from sliding down from the plant stake when in the upturned position.

Preferably the plant stake, as shown in the embodiment of FIG. 3A, is provided with an upper stop surface 8 and a lower stop surface 11 on both sides. In the figure the top surfaces according to the preferred embodiment are situated almost vertically above each other. As a result the information can be brought into an almost completely vertical position, as can be seen in FIG. 3B. In FIG. 3B it can be seen that when the information label 1 is completely turned upwards, further rotation of the information label can be prevented on the one hand by the upper stop surface 8 and on the other hand by the lower stop surface 11. The notch 6 then offers room for rotating the information label. Rotation is made more easy here by notch 13, which is shown in FIG. 3A. To detach the information label from the plant stake, the information label has to be moved straight downwards from the position shown in FIG. 3B up until the side of hole 2 touches the plant stake. The information label now has to be rotated anti-clockwise about the point where the side of hole 2 abuts the plant stake, more or less keeping contact with the plant stake. When rotating the hole 2 revolves around the top side 7 or notch 6, and the side of the information label which is situated in the notch 6 moves out of the notch. When the hole 2 has passed the top side 7 of the notch 6, the information label can be moved upwards and be removed from plant stake 3.

Preferably, as can be seen in the FIGS. 3A and 3B, the smallest distance between the top side 7 of notch 6 and the top side of the upper stop surface 8 is larger than the largest diameter or the width of the hole 2 in the information label, so that the information label cannot get detached from the plant stake just like that. For easy removal of the information label the largest distance between the top side 7 of notch 6 is smaller than the largest diameter of the hole 2 of the information label.

Figure 3C:
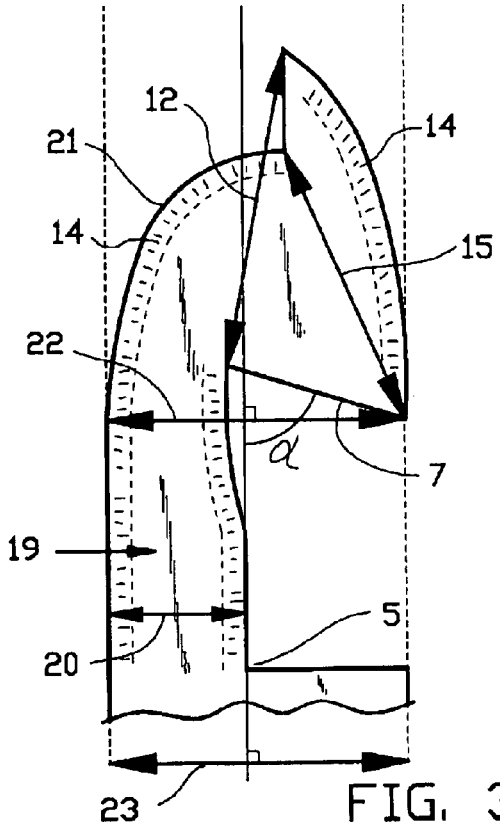
FIG. 3C shows an enlargement of FIG. 3A in which the most important distances have been indicated.

In FIG. 3C the most important dimensions of the plant stake are shown, The distance indicated by 12 is the smallest distance between the top side of the upper stop surface. Said distance here, as can be seen in FIG. 3B, is larger than the largest diameter of the hole 2 in the information label 1. As a result the information label will not get detached from the plant stake when reading the back.

The second distance shown in FIG. 3C is the distance 15. Said distance is smaller than the largest diameter of the hole 2 in information label 1. In this way the information label can be removed from the plant stake in the following manner. The information label is first rotated upwards from the position indicated in FIG. 3A, into the position indicated in FIG. 3B. Just before or up until the information label has run into stop surface 8, i.e. in the position indicated in FIG. 3B, the upward movement stops. The information label is then moved straight downwards until what presently is the top side of hole 2 abuts the plant stake. Said top side of hole 2 is held against the plant stake 3 whereas the information label 1 is rotated downwards. As a result the other, opposite side of the hole 2 passes the top side 7 of notch 6. The information label 1 can be rotated further and is released from plant stake 3.

The angle indicated in FIG. 3C by α, the downwardly opening angle between the top side of the notch and the longitudinal axis of the plant stake, in this preferred embodiment is 90 degrees at a maximum. If so desired the top side 7 of the notch will not run level. Preferably, however, there should be an area along top side 7 then, where the smallest distance to the top side of stop surface 8 is larger than the largest diameter of hole 2 and further to the outside an area along 7 where the distance to the bottom side of stop surface 8 is smaller. In this way the information label 1 cannot get detached from the plant stake 3 when reading the back, that means when the information label 1 is in the position shown in FIG. 3B. In the detailed drawing it can also clearly be seen that the plant stake 3 is inclined on several sides, that means made thinner, as a result of which the information label moves easily along the plant stake. Some of its parts are indicated by number 14.

In FIG. 3C the width of the neck 19 is indicated by number 20. Through the choice of said width at the level of the abutment surface 5 with respect to the diameter of the hole 2 in the information label 1 it becomes possible to adjust the degree of inclination with which the information label will hang from the plant stake. In this way it is also possible to select the position of the plant information label to such a degree that it stands optimal in the view direction of the consumer.

In order to prevent that the information label will slide downwards from the plant stake it is preferred that the diameter of the hole 2 is smaller than the width below abutment surface 5, indicated in the figure by number 23. In order to prevent detachment of the label in upward direction it is preferred that the width at a position at the top side, in the figure indicated by number 22, is larger than the diameter of the hole 2 in the information label 1. The side 21 of the plant stake opposite notch 6 has a round course from the neck 19 to the bottom side of the stop surface 8.

In order to easily produce the plant stake it is preferred, as shown in the figure, that the distance 22 is substantially equal to distance 23. The plant stake will then have no projecting parts beyond the continuation of the strip-shaped plant stake.

It may be clear that it is of course possible to make the plant stake thicker than the width of the plant stake in the direction perpendicular to the figures. However, because of the use of material and the costs this entails, this will not be desirable.

Furthermore many modifications and adjustments to what has been described above can be made to adapt to special situations without departing from the essence of the invention.

What I claim is:

1. A plant stake assembly comprising:

a plant information label provided with a hole and print on at least on surface;

a plant stake for holding the plant information label, the plant stake comprising:

a first abutment surface on a first side;

a second abutment surface on a second side;

wherein at least one of the first abutment surface is formed in a notch; and wherein the notch provides room for rotation of the plant information label; end wherein the label abuts the first and second abutment surfaces.

2. The plant stake assembly according to claim 1, in which the abutment surface in the notch is situated above the abutment surface on the other side of the plant stake.

3. The plant stake assembly of claim 2 wherein a plane of the label is oriented obtusely with the plant stake when the plant information label is supported only by the plant stake.

4. The plant stake assembly according to claim 1, wherein the plant stake is further provided with at least one stop surface, separate from the abutment surfaces, on the first side or the second side for limiting rotation of the information label.

5. The plant stake assembly of claim 4 wherein a plane of the label is oriented obtusely with the plant stake when the plant information label is supported only by the plant stake.

6. The plant stake assembly according to claim 3, further comprising two stop surfaces that are substantially vertically situated above each other.

7. The plant stake assembly according to claim 6, wherein an upper one of the stop surfaces has a top and wherein the notch has a top in which the shortest distance between the top of the notch and the top of the upper stop surface is longer than the largest diameter of the hole of the plant information label.

8. The plant stake assembly of claim 6 wherein a plane of the label is oriented obtusely with the plant stake when the plant information label is supported only by the plant stake.

9. The plant stake assembly according to claim 1, in which the ratio between the dimensions of the hole and the length and the width of the plant stake is such that the plant information label can be arranged on the stake.

10. The plant stake assembly according to claim 9, wherein the plant stake has a passage portion having a largest diameter which is smaller than the largest diameter of the hole of the plant information label.

11. The plant stake assembly according to claim 1, wherein the plant stake has a longitudinal axis and the notch is bounded by an upper edge, said upper edge slanting downward outwardly and having an angle of 90 degree or less, measured from the longitudinal axis.

12. The plant stake assembly according to claim 1, wherein the first and second abutment surfaces are located above one another to form an upper abutment surface and a lower abutment surface in which the upper abutment surface has a vertical component.

13. The plant stake assembly according to claim 1, wherein the first and second abutment surfaces are located above one another to form an upper abutment surface and a lower abutment surface in which the plant stake is provided with a shoulder either from or below the upper abutment surface.

14. The plant stake assembly according to claim 1, in which the hole is substantially slot-shaped or rectangular.

15. The plant stake assembly according to claim 1, in which the plant stake has a substantially flat rectangular cross-section.

16. The plant stake assembly according to claim 1, wherein the information on the label runs from top to bottom on one side and from bottom to top on a second side.

17. The plant stake assembly according to claim 1, in which the width of the notch which offers room for rotation is larger than the distance from the top of the information label to the hole therein.

18. The plant stake assembly according to claim 1, wherein the plant stake has an upper stop surface for limiting the rotation of the plant information label, said upper stop surface having a lowest, point, the notch being bounded by an upper edge; and wherein the distance form the lowest point of the upper atop surface to the notch upper edge is smaller than the diameter of the hole of the plant information label.

19. The plant stake assembly according to claim 1, wherein the plant stake has an upper stop surface for limiting the rotation of the plant information label; and wherein the side of the plant stake extending from the stop surface to below has a rounded course.

20. The plant stake assembly according to claim 1, in which the width of the plant stake above the notch is larger than the largest width of the hole in the information label at at least one location.

21. The plant stake assembly according to claim 1, wherein the plant stake is strip-shaped; and wherein the plant stake for limiting the rotation of the plant information label; and wherein the side of the plant stake extending from the stop surface to below has a rounded course.

22. The plant stake assembly of claim 1 wherein a plane of the label is oriented obtusely with the plant stake when the plant information label is supported only by the plant stake.

23. The plant stake assembly of claim 1 wherein the plant information label is flexible.

24. Plant stake for holding a plant information label, which plant stake at the top is provided with a thickening, with a neck below the thickening and with a shoulder below the neck, in which the thickening blocks removal of the plant information label when it is situated in an inclined presentation position or in an upwardly turned position to read the back, or in positions to get from the inclined presentation position into the upwardly turned position, but comprising a passage portion as a result of which the plant information label can be removed from the plant stake, the neck together with the shoulder offering room for tilting the plant information label to read the back without substantially bending the plant information label, and which neck because of an uncircular cross-section corresponding to a hole in the plant information label prevents rotation of the plant information label in the plane of the plant information label in a inclined direction to a viewer, and the shoulder preventing the plant information label from sliding down.

25. Plant stake for holding a plant information label, in which the plant stake is provided with a neck, in which the neck has an uncircular cross-section and the plant information label is provided with visual information and with a corresponding uncircular hole, and in which the neck is formed for guiding the plant information label on the plant stake during tilting of the plant information label on the neck from at least a first position to a second position.

26. A plant stake assembly comprising:

a plant stake for holding a plant information label, the plant stake comprising:

a first abutment surface on a first side;

a second abutment surface on a second side;

wherein at least one of the first or second abutment surfaces is formed in a notch; and wherein the notch offers room for rotation of the plant information label; and a plant information label having a hole adapted such that a portion of the plant stake can extend therethrough, the plant information label including printing on a first side that can be read from top to bottom when the plant information label is supported only by the plant stake and contacts the first abutment surface, the plant information label further including printing on a second side that can be read form bottom to top when the information label is rotated and contacts the second abutment surface.

27. The plant stake assembly of claim 26 wherein a plane of the label is oriented obtusely with the plant stake when the plant information label is supported only by the plant stake.

28. A plant stake assembly comprising:

a plant stake for holding a plant information label, the plant stake comprising:

an abutment surface on a first side; end a plant information label having a hole adapted such that a portion of the plant stake can extend therethrough, the plant information label including printing on a first side that can be read from top to bottom when the plant information label is supported only by the plant stake and contacts the abutment surface, the plant information label further including printing on a second side that can be read from bottom to top when the information label is rotated upwardly.

29. The plant stake assembly of claim 28 wherein a plane of the label is oriented obtusely with the plant stake when the plant information label is supported only by the plant stake.

30. The plant stake assembly of claim 28 wherein the plant information label is flexible.

* * * * *